US007708667B2

(12) United States Patent
Alexander

(10) Patent No.: US 7,708,667 B2
(45) Date of Patent: May 4, 2010

(54) TRAMPOLINE AND ENCLOSURE SYSTEM

(75) Inventor: Keith Vivian Alexander, Christchurch (NZ)

(73) Assignee: Board & Batten International Inc., Georgetown (KY)

( * ) Notice: Subject to any disclaimer, the term of this patent is extended or adjusted under 35 U.S.C. 154(b) by 305 days.

(21) Appl. No.: 10/560,335

(22) PCT Filed: Jun. 9, 2004

(86) PCT No.: PCT/NZ2004/000118

§ 371 (c)(1),
(2), (4) Date: Jun. 15, 2006

(87) PCT Pub. No.: WO2004/108221

PCT Pub. Date: Dec. 16, 2004

(65) Prior Publication Data

US 2007/0004559 A1 Jan. 4, 2007

(30) Foreign Application Priority Data

| | | |
|---|---|---|
| Jun. 9, 2003 | (NZ) | 526353 |
| Oct. 15, 2003 | (NZ) | 528909 |
| Dec. 19, 2003 | (NZ) | 530270 |

(51) Int. Cl.
*A63B 5/11* (2006.01)
*A63B 26/00* (2006.01)

(52) U.S. Cl. ..... 482/27; 482/28

(58) Field of Classification Search ..... 482/121, 482/27, 28, 29; 472/116, 117; 52/234; 5/710, 5/187, 189, 11

See application file for complete search history.

(56) References Cited

U.S. PATENT DOCUMENTS

| | | | | |
|---|---|---|---|---|
| 5,399,132 | A | 3/1995 | Bailey | |
| 5,941,798 | A * | 8/1999 | Coan et al. | 482/27 |
| 6,053,845 | A | 4/2000 | Publicover et al. | |
| 6,135,922 | A | 10/2000 | Nissen | |
| 6,261,207 | B1 * | 7/2001 | Publicover et al. | 482/27 |
| 6,319,174 | B1 | 11/2001 | Alexander | |
| 2002/0137589 | A1 * | 9/2002 | Banno et al. | 475/231 |
| 2003/0064861 | A1 | 4/2003 | Chen | |
| 2005/0079954 | A1 * | 4/2005 | Wang et al. | 482/27 |
| 2007/0111860 | A1 * | 5/2007 | Publicover | 482/27 |

FOREIGN PATENT DOCUMENTS

| | | |
|---|---|---|
| WO | WO 03/043704 | 5/2003 |

* cited by examiner

*Primary Examiner*—Jerome Donnelly
(74) *Attorney, Agent, or Firm*—Dann, Dorfman, Herrell and Skillman, P.C.

(57) ABSTRACT

A trampoline has an enclosure system including a barrier of a flexible material (14) such as a net material surrounding the trampoline mat above the mat and having a lower peripheral part coupled directly or indirectly to the mat, and a plurality of resiliently flexible generally upright enclosure support members or rods (13) which are retained at or towards the lower ends of the enclosure support members and below the mat (1) by the frame (4) of the trampoline and which support the net above the mat, so that the enclosure is free to deform away from the mat when impacted by a user against an enclosure support member and/or against said barrier of flexible material.

35 Claims, 11 Drawing Sheets

TRAMPOLINE AND ENCLOSURE SYSTEM

FIELD OF THE INVENTION

The present invention relates to an improved enclosure for a trampoline, and a trampoline and enclosure system.

BACKGROUND TO THE INVENTION

U.S. Pat. No. 6,053,845 describes an enclosure for a trampoline consisting of a net fence or barrier which surrounds the trampoline and is supported by upright poles spaced around the periphery of the trampoline and fixed to the trampoline frame.

U.S. Pat. No. 6,319,174 discloses a form of soft-edged trampoline in which the mat of the trampoline is supported by a plurality of resiliently flexible rods received in a frame of the trampoline at the lower ends of the rods and coupled to the periphery of the bouncing mat of the trampoline at their upper ends, and which avoids the need for a solid frame about the exterior of the bouncing mat and exposed springs between the frame and periphery of the mat.

SUMMARY OF THE INVENTION

It is an object of the invention to provide an improved or at least alternative trampoline enclosure, for a soft-edged trampoline.

In one aspect the invention may be said to comprise a trampoline and enclosure system including: a flexible mat; a plurality of resiliently flexible spring rods each having a lower end retained by a frame of the trampoline and an upper end coupled to the mat about a periphery of the mat; a barrier of a flexible material surrounding the mat above the mat and having a lower peripheral part coupled directly or indirectly to the mat; and a plurality of resiliently flexible generally upright enclosure support members outside of the barrier relative to the mat and which are retained at or towards the lower ends of the enclosure support members and below the mat by the frame of the trampoline and which support the net above the mat, which are free to deform away from the mat when impacted by a user against an enclosure support member and/or against said barrier of flexible material.

Typically the barrier comprises a flexible net material and the enclosure support members are resiliently flexible rods such as pultruded fibreglass rods.

The barrier may be supported by the enclosure support members by connections between the barrier at or towards an upper peripheral edge part of the barrier and the enclosure support members at or towards the upper ends of the enclosure support members which draw the upper ends of the enclosure support members away from their natural rest state (when connected only at their lower ends to the frame of the trampoline), and towards the centre of the mat. Alternatively a flexible connecting element may connect the enclosure support members at or towards the upper ends of the enclosure support members to draw the upper ends of the enclosure support members away from their natural rest state (when connected only at their lower ends to the frame of the trampoline), and towards the centre of the mat.

The upper ends of the flexible spring rods may pass through a lower peripheral section of the barrier below the mat to couple the barrier to the mat.

Preferably the lower ends of the enclosure support members are retained by the frame of the trampoline so that in their natural rest state (when connected only at the lower ends to the frame of the trampoline) the enclosure support members extend away from the mat.

In broad terms in another aspect the invention may be said to comprise a trampoline and enclosure system including: a flexible mat; a plurality of resiliently flexible spring rods each extending between a base frame of the trampoline and a periphery of the mat; a barrier of a flexible material surrounding the mat above the mat and having a lower peripheral part coupled directly or indirectly to the mat; and a plurality of resiliently flexible enclosure support rods coupled to the trampoline only by a lower end of each enclosure support rod being retained by the base frame of the trampoline, and which extend above the mat to support the net above the mat.

In this specification (including claims) the term "trampoline" is intended to extend to smaller trampolines commonly referred to as rebounders also, as well as larger trampolines of all sizes. Trampolines of the invention may be circular, square, rectangular, or of other shapes such as octagonally shaped in plan view for example.

BRIEF DESCRIPTION OF THE DRAWINGS

Preferred embodiments of the invention will be described with reference to the accompanying drawings, of which.

DETAILED DESCRIPTION OF THE PREFERRED EMBODIMENTS

Figure 1:
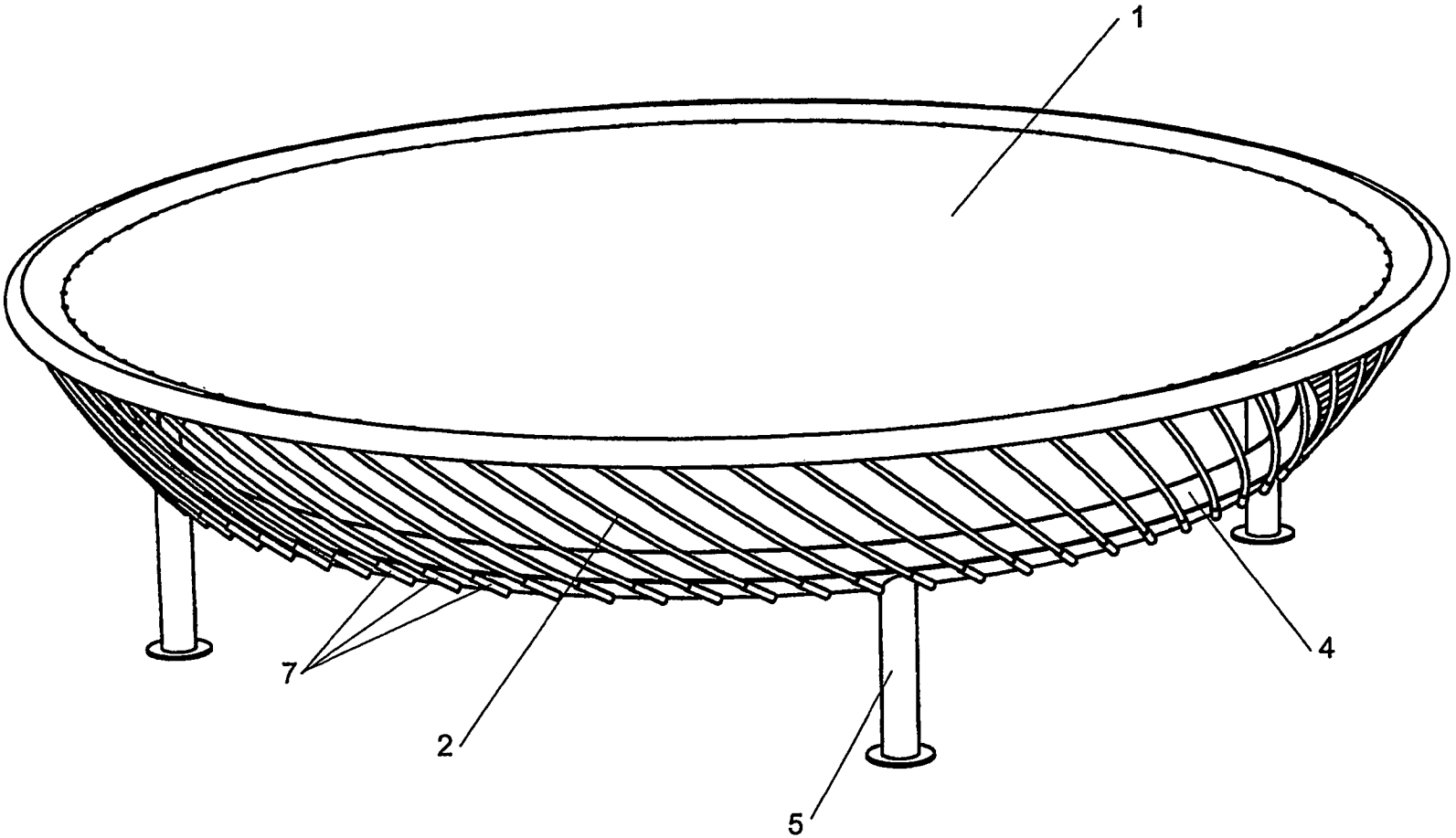
FIG. 1 is a perspective view of a preferred form soft-edge trampoline.
Figure 2:
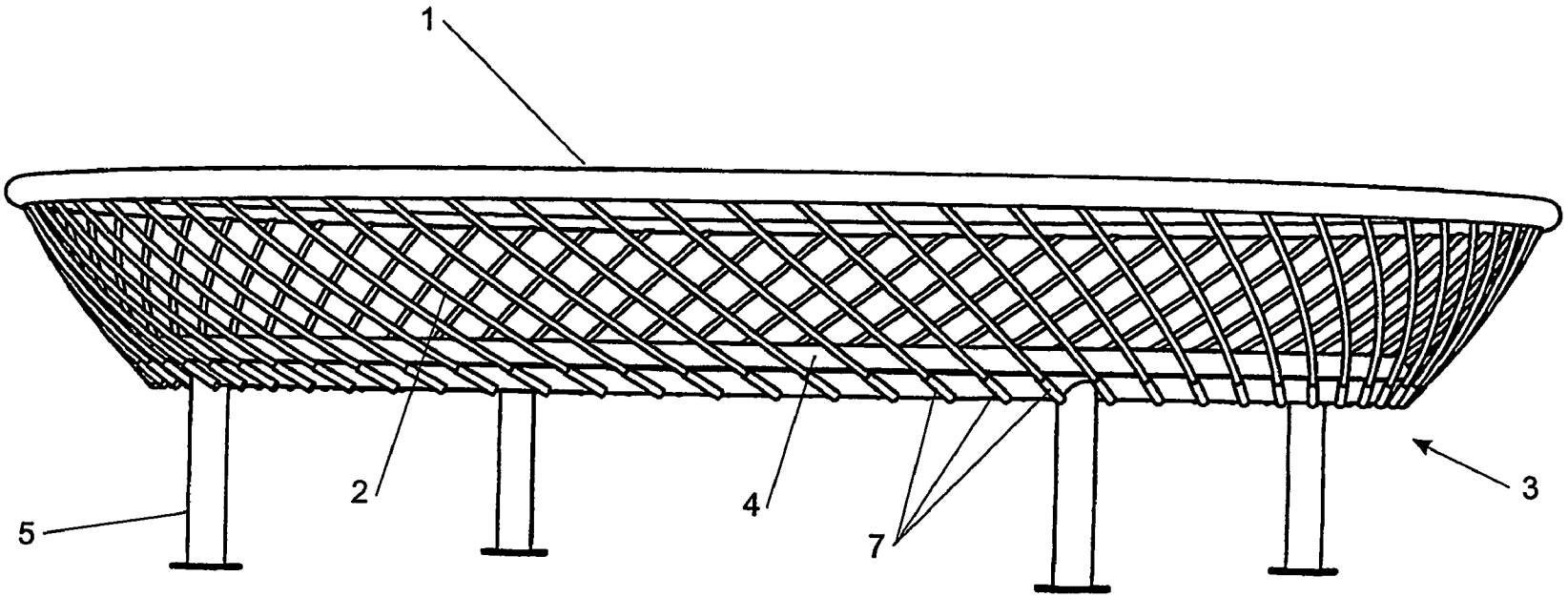
FIG. 2 is a side view of the trampoline of FIG. 1.
Figure 3:
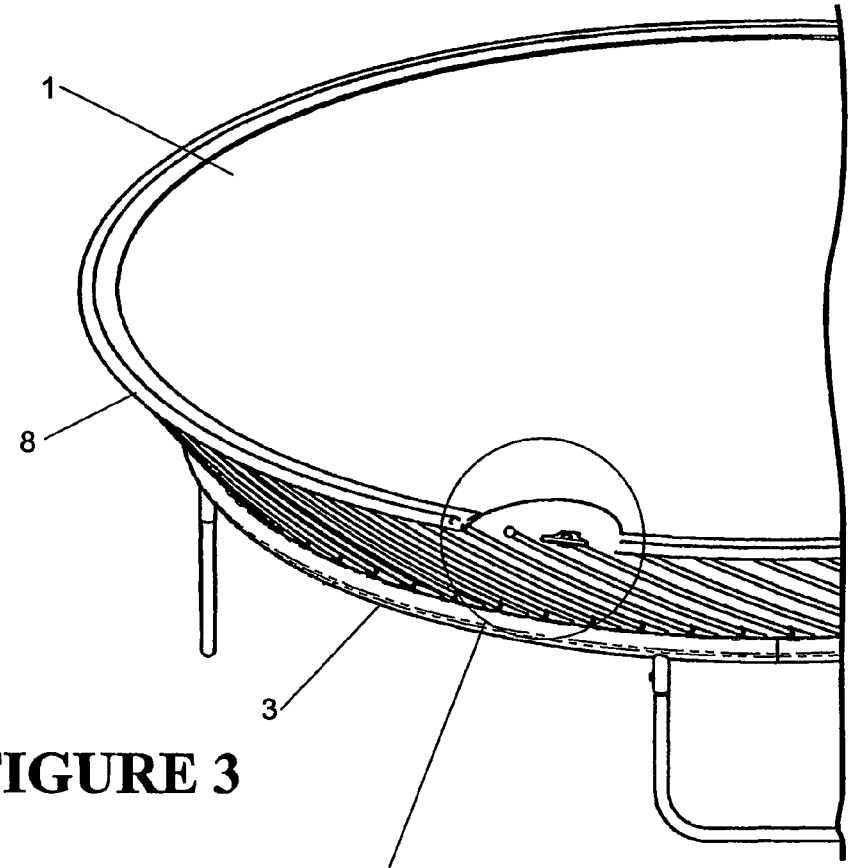
FIG. 3 is similar to FIG. 1 but of one side of the trampoline only and showing a portion of the edge of the mat of the trampoline cut away.
Figure 3A:
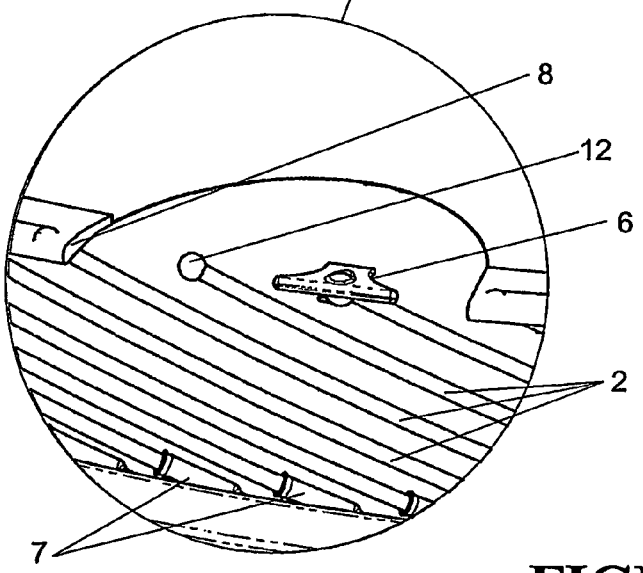
FIG. 3*a* is an enlarged view of the cut away edge portion of the trampoline.

Referring to FIGS. 1 to 3, a soft-edged trampoline typically comprises a flexible mat 1 on which users may bounce, a plurality of resiliently flexible spring rods 2, and a base frame 4. The base frame of the preferred form trampoline comprises a circular beam 4 typically formed of steel or aluminium for example, and may include legs 5. The preferred form trampoline shown is circular in shape but the trampoline could be of any other desired shape such as oval, square, rectangular or similar.

The spring rods 2 are typically fibreglass rods but may alternatively be formed of spring steel for example. The lower ends of the rods are retained by the base frame 4 and the upper ends of the rods connect to fittings 6 as will be further described, which are coupled to the mat 1 about the periphery of the mat. In the preferred form the lower ends of the rods 2 enter into tubular holders 7 fixed to the circular beam as shown, but the lower ends of the rods may be coupled to the circular beam, or a base frame of the trampoline of any other form, in any suitable way.

In the preferred form the mat, which is typically heavy canvas or a woven synthetic material, is doubled back upon itself and fixed by stitching for example about the periphery of the mat to form a continuous pocket 8 extending about the periphery of the mat. A number of the fittings 6 are positioned within this pocket in the peripheral edge of the mat as shown in FIG. 3 in particular. The fittings may be loosely captured within the pocket or alternatively may be stitched to the mat within the edge pocket, or mechanically fastened to the mat via rivets for example (see WO 03/043704 the entire disclosure of which is incorporated herein by reference).

The upper ends 12 of the spring rods 2 connect to the fittings 6. Preferably the fittings have a generally planar body portion 9, and a socket cavity 10 is defined on or in an underside of the body portion 9 of the fitting. Preferably the body 9 of the fitting has a greater dimension approximately in the plane of the mat than in a direction through the mat. Typically the fittings will be formed from a plastics material, by injection moulding for example.

In use as the trampoline is bounced on by a user, this will cause pivotal movement between the upper ends 12 of the rods 2 and the fittings 6 coupled to the mat, to a greater or lesser extent depending upon the size and energy of the user.

Figure 4:
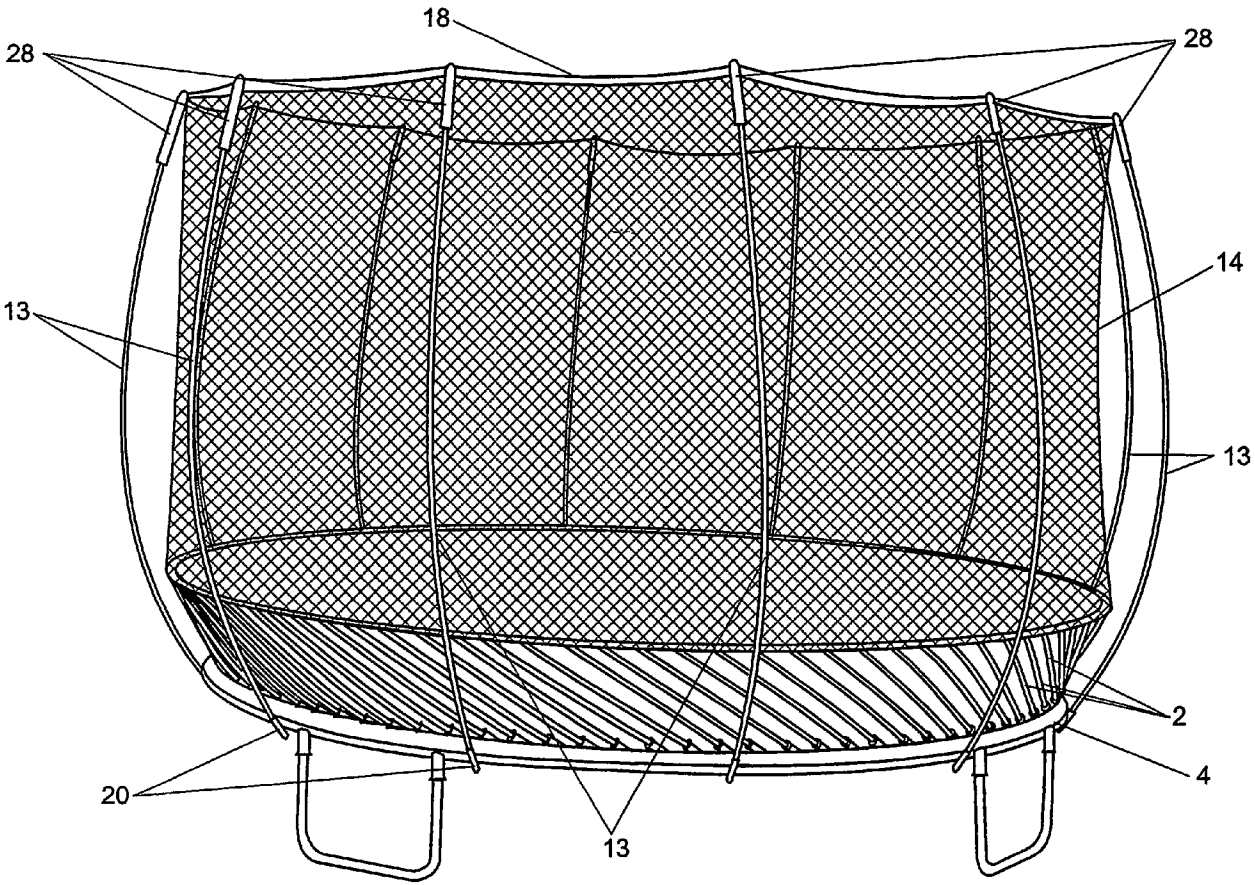
FIG. 4 shows an enclosure according to one embodiment of the invention installed on a soft edge trampoline similar to that of FIGS. 1 to 3, FIGS. 5 and 6 illustrate the trampoline and enclosure system of FIG. 4 in use.

Referring to FIG. 4, the trampoline also comprises an enclosure system as shown. The enclosure system consists of a plurality of resiliently flexible generally upright enclosure support members 13 which in the preferred form are flexible or deformable fibreglass rods and may in particular be pultruded fibreglass rods, but may alternatively be spring steel elements for example. Hereinafter the enclosure support members 13 will be referred to as enclosure rods for convenience, but it is to be understood that this term is non-limiting in relation to the size and cross-sectional shape of the enclosure support elements and the material from which they are formed, provided that they provide the required degree of flexibility in accordance with the invention. The enclosure system also comprises a barrier net 14. The enclosure rods 13 support the net 14 above the mat, and the lower edge of the barrier net 14 is coupled directly or indirectly to the peripheral edge of the mat. The barrier 14 will typically be formed of a lightweight but strong net material but may alternatively be a flexible fabric material which is for example opaque or which is perforated so as to be semi-opaque. The enclosure rods 13 are positioned on the outside of the net 14 as shown. The enclosure rods are coupled to the trampoline frame at the lower ends of the enclosure rods and to the upper peripheral part of the net at or towards the upper ends of the enclosure rods. Preferably the enclosure rods are coupled to the base frame of the trampoline at about the level on the frame of the trampoline at which the lower ends of the flexible spring rods are also retained by the frame of the trampoline, and to the frame member 4 in the preferred form. Alternatively however, the lower ends of the enclosure rods may be coupled to the trampoline base frame somewhat below or above the frame member 4 or equivalent, but below the level of the mat 1 itself.

Figure 5:
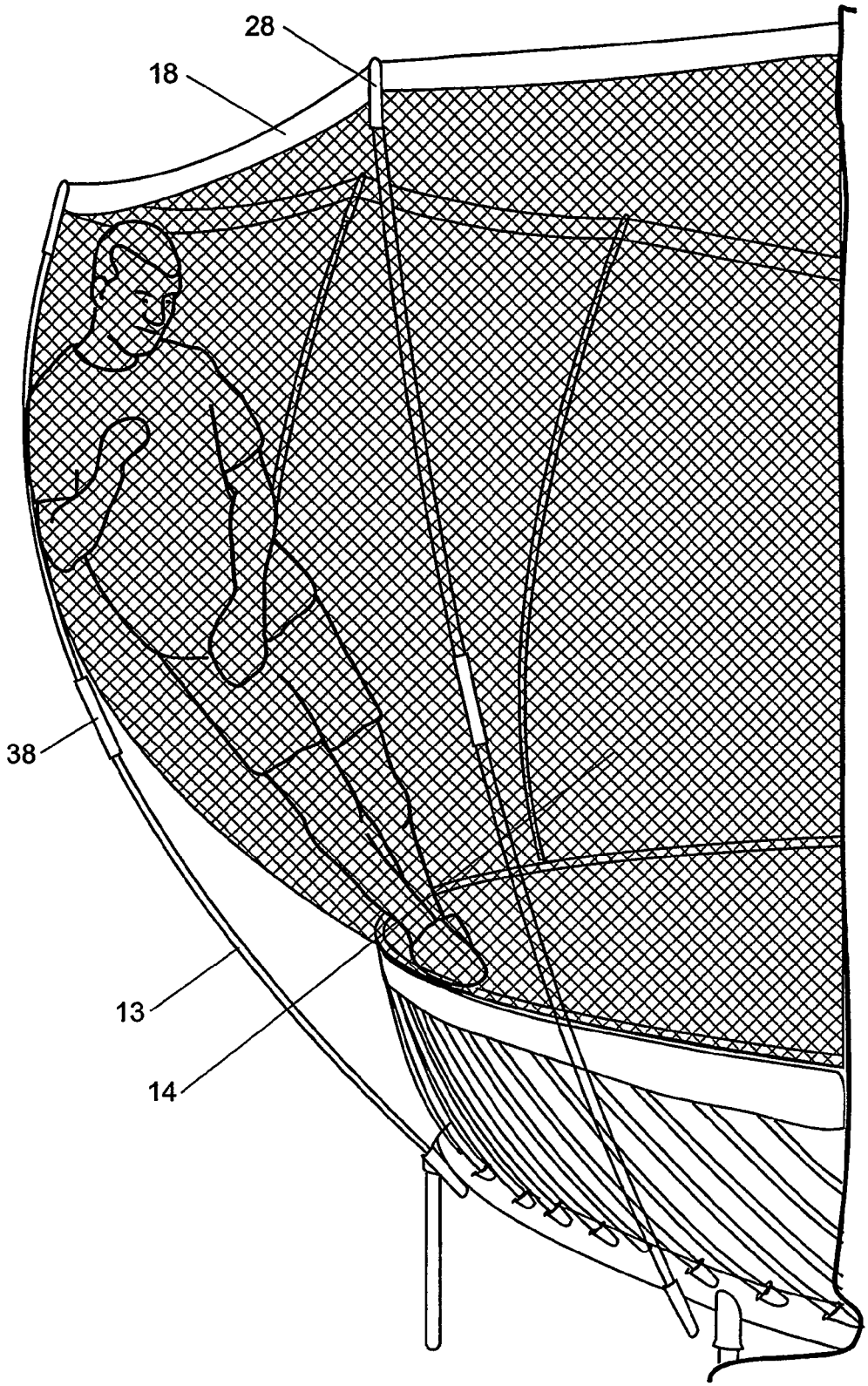
Figure 6:
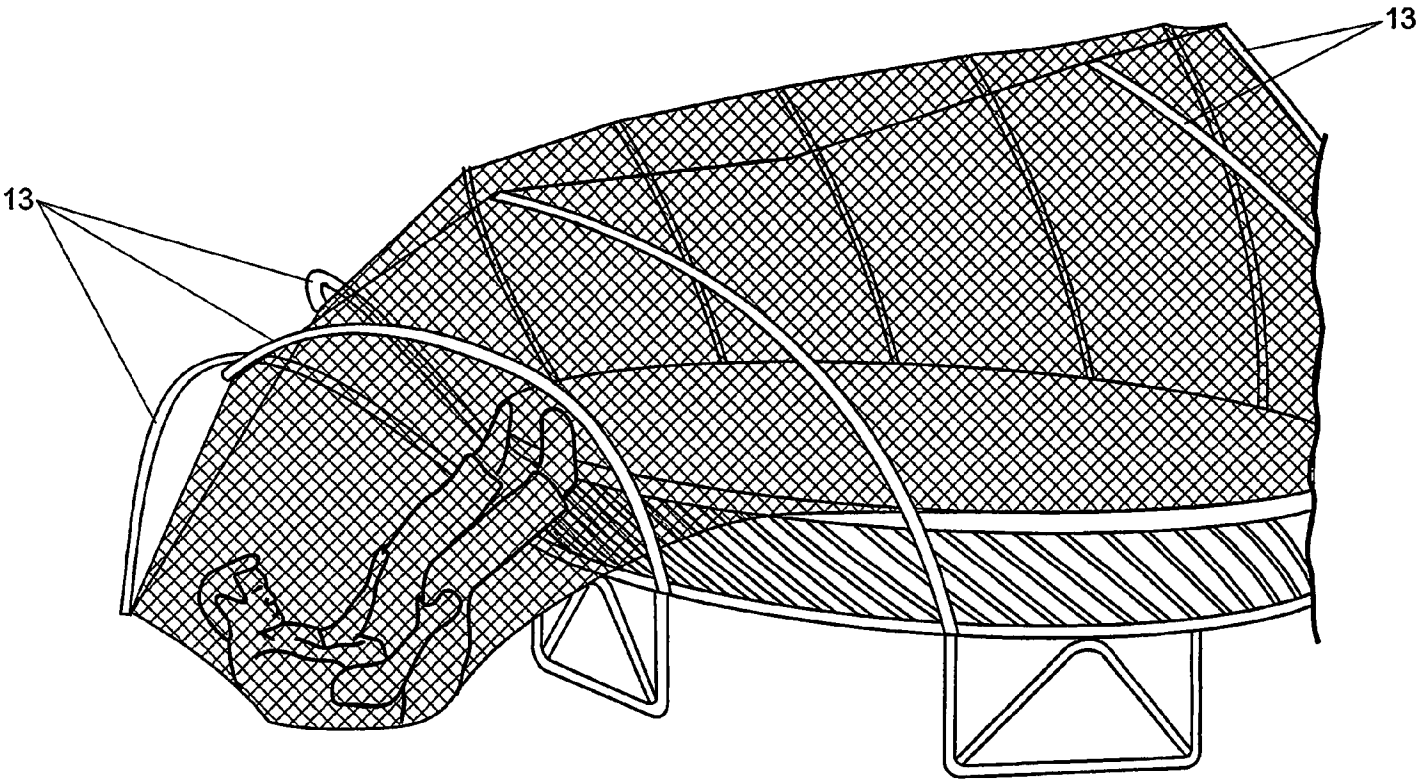

The enclosure system has a high degree of flexibility or deformability. This is illustrated in FIGS. 5 and 6. FIG. 5 shows a user leaning against the barrier net 14 and one enclosure rod 13, and it can be seen that the enclosure rod deforms away from the trampoline. At the same time the lower edge of the net remains coupled to the trampoline mat. Typically when an average sized or weight user hits the enclosure so that the enclosure deforms to this extent, the impact energy absorbed by the enclosure will gently rebound the user back onto the trampoline mat. Very preferably the upper ends of all of the enclosure rods 13 are connected together so that all of the enclosure rods 13 and net 14 form a dynamic rebound surface. That is, a user impacting any side of the enclosure will cause all of the rods to deform to some extent. This is shown in the extreme in FIG. 6 in which a user has impacted one side of the enclosure with sufficient force or momentum that the user has fallen from the trampoline mat, whilst at the same time being caught by the enclosure so as to minimise the risk of injury to the user.

In a most simple form the upper ends of all of the enclosure rods 13 may be connected by a line. In the preferred form shown a band 18 such as a webbing strap fixed for example by sewing to the upper peripheral edge of the barrier net 14 couples the upper ends of all of the rods 13. Preferably the rods are coupled so that they are bowed or drawn away from their natural state of rest (when connected only at their lower ends to the frame of the trampoline) and towards the centre of the mat. In an alternative form a line or band may couple the enclosure rods at or towards their upper ends, which is a separate component from the net itself. Such a separate band or line may incorporate a buckle or adjustable connector which allows for adjustment of the length of the band or line to enable the degree of pre-tension applied to the enclosure rods 13 to be varied, thus varying the strength of rebound that will be provided. Because the enclosure rods are preferably coupled to the trampoline and mat only at or towards their lower ends below the mat, they are free to move relative to the mat as shown in FIGS. 5 and 6 in particular. As illustrated particularly in FIG. 6 the enclosure rods are free to deflect or deform in almost any plane. The enclosure rods are highly flexible or deformable. The degree of resilience may be such that an average size or weight user (for example a 80 kg user) deforming the enclosure to the extent shown in FIG. 5 will be rebounded back onto the mat whereas the same user deforming the enclosure to the extent shown in FIG. 6 will not naturally be rebounded back onto the mat—the user must also pick him or herself up or be pulled up by another user or player still on the mat, but will be assisted in returning to the mat also by the rebound force of the enclosure system. While the enclosure rods are not coupled to the trampoline at about the level of the mat, that is not to say however that large loops, for example a flexible webbing material or rigid plastic loops may not be provided which will allow the part of the trampoline rod at about the same level as the mat to move relatively freely relative to the mat as shown, whilst at the same time limiting extreme movement of the enclosure rods 13.

Typically the trampoline will be delivered to a purchaser in disassembled form. The enclosure may be supplied together with the trampoline or separately, and may be factory fitted, or retrospectively self-fitted by a user. It may come in component form as a kit, or preassembled for attachment to the trampoline. This provides an enclosure that is specifically designed to function as a play addition to the soft-edge trampoline.

The particular combination of the soft-edge trampoline and the enclosure system is uniquely suited to the use of the enclosure in trampoline play because a jumper hitting the enclosure wall and falling on the trampoline edge is in no danger of injury as the trampoline edge is soft and designed for such an event. As the trampoline frame is underneath the trampoline mat, the frame will not be hit when rebounding off the enclosure wall. Also the thin flexible fibreglass rods which are preferably used are both difficult for the jumper to hit and readily move on impact so as not to cause injury.

Referring again to FIGS. 4 to 6 the enclosure rods 13 are outside and thus removed from the direct area of play as to be more difficult to hit, are flexible and mounted by their lower ends only so as to not cause injury when they are hit from the side, are so flexible as to be unlikely to cause injury if landed on from above, but provide enough tension to the net to give the required rebounding response to a jumper hitting it.

Figure 7:
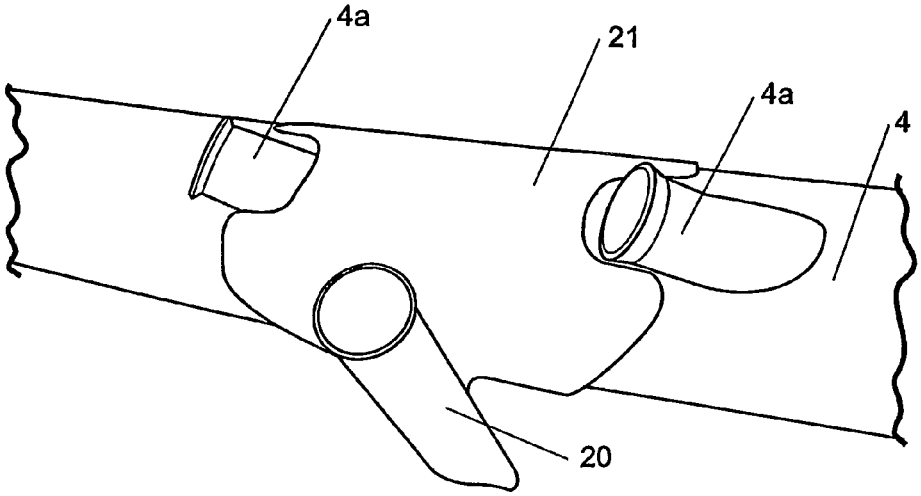
FIGS. 7, 8 and 9 show holders on the trampoline base frame for retaining the lower ends of the enclosure support members.
Figure 8:
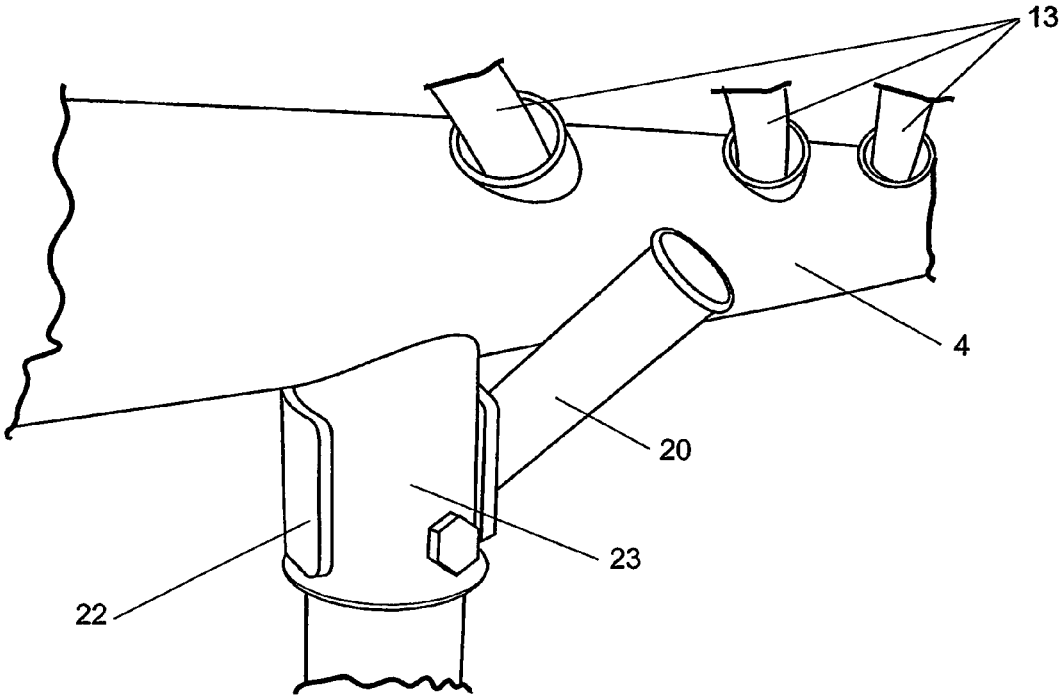
Figure 9:
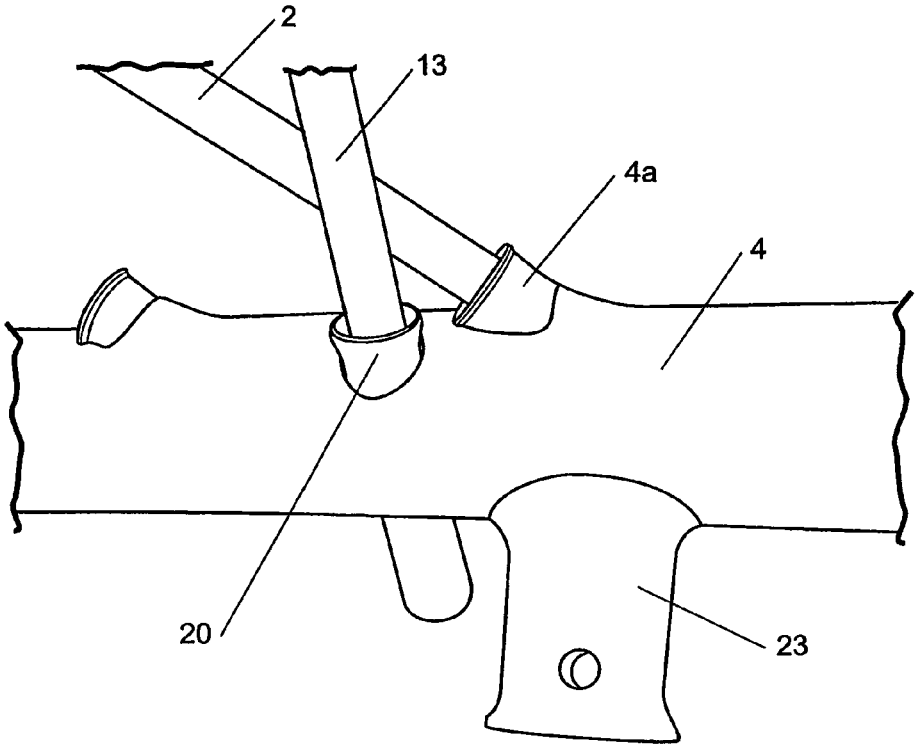

FIGS. 7, 8 and 9 show how the lower ends of the enclosure rods 13 may be retained by the trampoline base frame. In FIG. 7 tubular socket 20 includes a curved bracket portion 21 for attachment to a peripheral part 4 of the trampoline frame. The bracket 21 includes a clamp (not visible) which encircles the frame and clamps the separate bracket 21 carrying socket 20, to the frame. The bracket 21 may be shaped to fit as shown between sockets 4*a* integral with the frame part 4, into each of which a lower end of a spring rod 2 of the trampoline is inserted during assembly of the trampoline (spring rods 2 not shown in FIG. 5). An enclosure may be sold for retrofitting to a trampoline including a barrier net, the enclosure support rods, and such a bracket 21/socket 20 component for mounting each enclosure rod 13.

In FIG. 6 the socket 20 again for retaining the lower end of an enclosure support rod 13 is carried by a U-shaped bracket 22 which connects to an upright leg part 23 of the base frame of the trampoline below part 4, as shown.

FIG. 7 shows an embodiment in which sockets 20 for the enclosure rods are integral with a peripheral frame part 4 of the trampoline, as are sockets 4*a* for the spring rods 2.

The sockets 20 or equivalent are preferably oriented so that the enclosure rods are preferably retained by the trampoline frame at their lower ends so that in the natural rest state of the enclosure rods, when connected only at their lower ends to the frame of the trampoline and before fitting of the barrier net, the enclosure rods will extend at an angle away from the mat of the trampoline as shown. Thus, when the net is fitted to connect the upper ends of the enclosure rods, or some other flexible connecting element which connects the upper ends of the enclosure rods is fitted, this will draw the upper ends of the enclosure rods away from their natural state of rest and towards the centre of the mat, to the position generally as shown in FIG. 4 of the preferred embodiment, to pre-tension the enclosure rods. The enclosure support rods acting like fishing rods, are set to hold up and tension the enclosure net adequately for the play function. The higher is such pre-tension in the support rods the stronger rebound capability the enclosure net has. In addition it may not be essential that the enclosure rods are mounted so that they extend in a vertical plane. Alternatively the enclosure rods may extend to one side or the other, in a plane at an angle to the vertical and/or horizontal. For example the enclosure rods may extend at a similar angle to that of the spring rods 2 around and above the mat of the trampoline, to still effectively support the barrier net.

Figure 10:
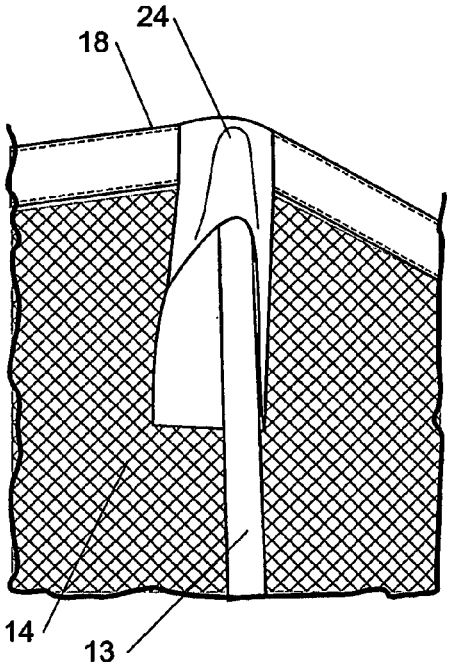
FIGS. 10 and 11 show a portion of the upper peripheral edge of the barrier net of the preferred form trampoline and the upper end of an enclosure support rod which engages into a pocket fixed to the upper edge of the barrier net.
Figure 11:
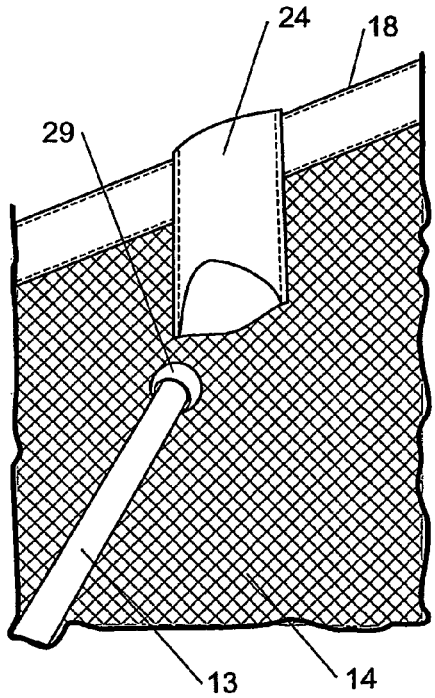
Figure 12:
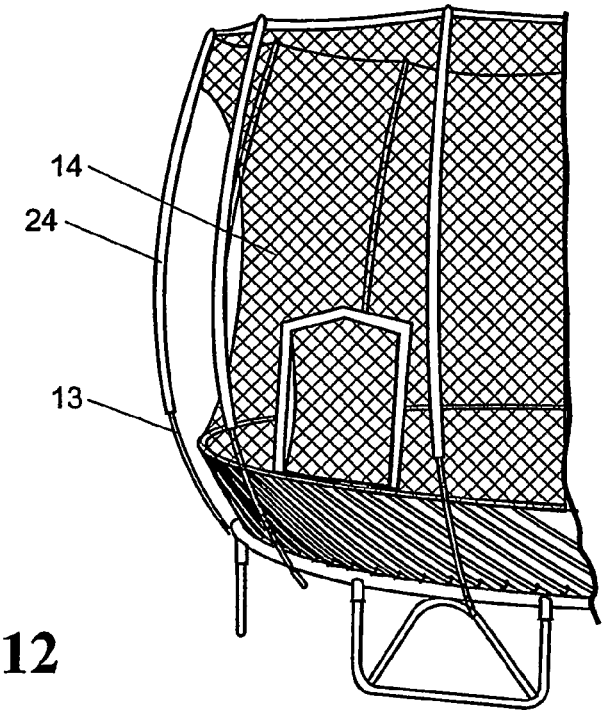
FIG. 12 shows one side of a preferred form trampoline and long pockets fixed to the upper edge of the barrier net and into which the enclosure support rods engage to mount the barrier net to the support rods, FIG. 13 schematically shows a further pocket system for mounting the upper peripheral edge of the barrier net to the upper ends of the enclosure support rods.

Referring to FIGS. 10 and 11, the enclosure net may be supported at its upper periphery by pockets 24 provided at or near an upper periphery of the enclosure net, which will fit over the upper ends of the enclosure rods 13 as shown. The pockets 24 may be stitched or otherwise fixed to the enclosure net and/or band 18 around the top of the enclosure. As shown in FIG. 12 the pocket 24 may be a long pocket into which a major part of the length of the enclosure rods 13 fits, but which is coupled to the barrier net only at or adjacent the upper peripheral edge of the net. Optionally such a long pocket 24 may be lined with or formed of a compressible material such as synthetic foam or foam rubber material to further reduce the risk of any injury on impact with the enclosure rod by a jumper. Such long pockets 24 reduce any risk of the pockets separating from the enclosure rods during active bouncing on the trampoline and against the barrier net. The risk of a bystander such as a child pulling an enclosure rod 13 from the pocket 24 is also reduced.

Figure 13:
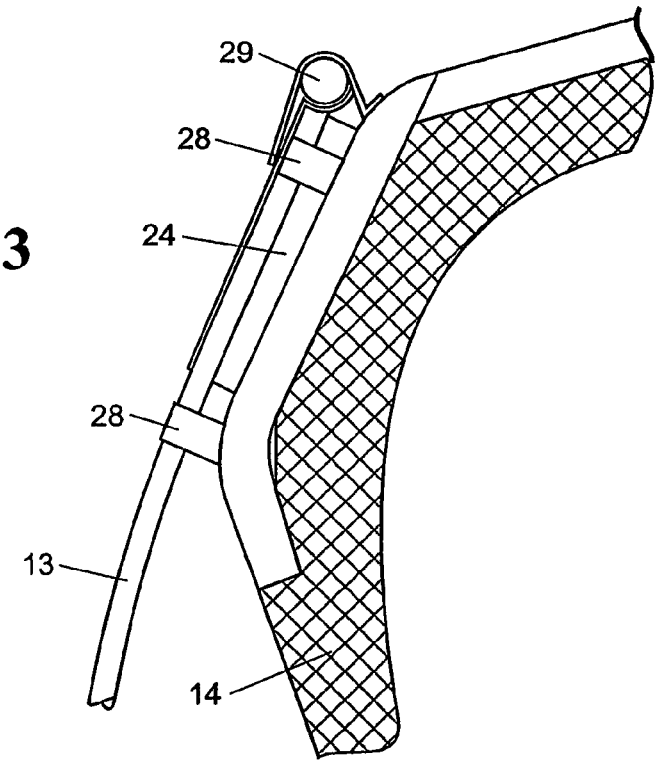

FIG. 13 shows an alternative arrangement in which again a pocket 24 is provided at the upper periphery of the enclosure net for each enclosure rod 13. In this embodiment the pocket 24 is a shorter length pocket as shown. Safety loops 28 typically formed of a webbing material are provided through which the upper end of the enclosure rod 13 passes, which take the approximately lateral load between the upper end of the enclosure rod and the barrier net, one safety loop 28 within the pocket and the other below the pocket as shown. Thus the contact point between the top of the pocket 28 and the upper end of the rod enclosure 13 carries only approximately vertical force. Preferably the upper end of the enclosure rod 13 in this and other embodiments is enlarged as shown for example by fitting of a ball shaped end 29 to the rod end.

Figure 14:
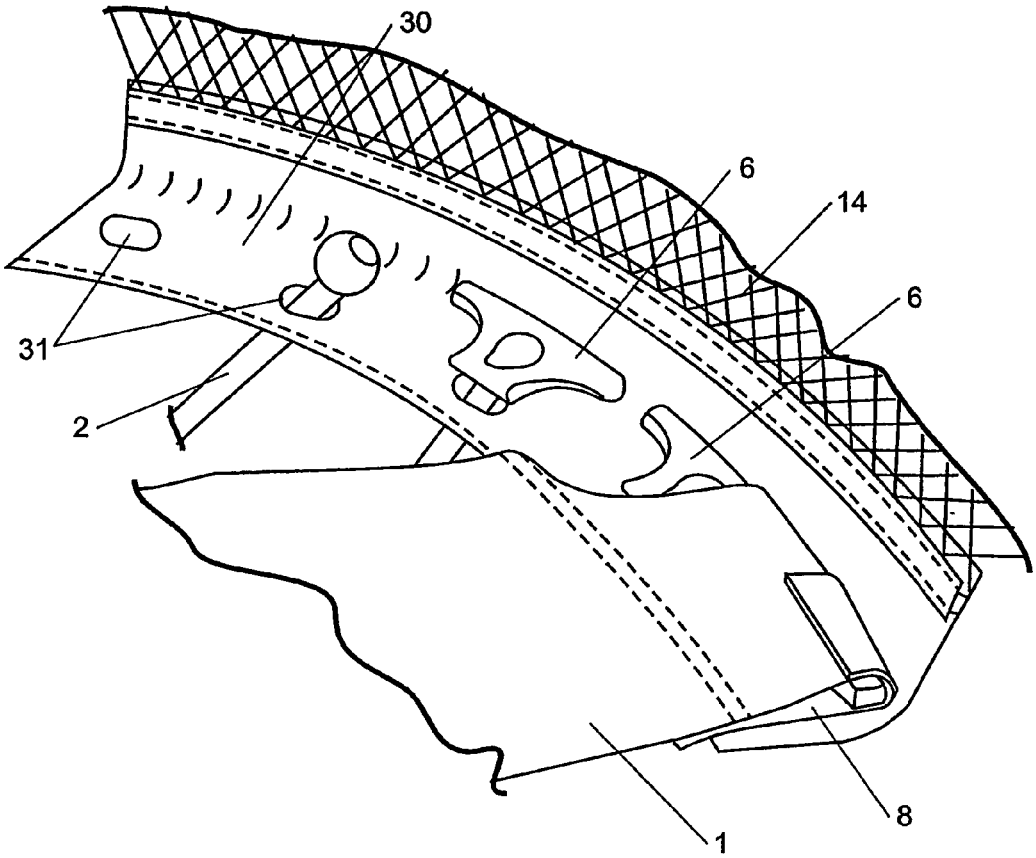
FIGS. 14 and 14*a* show a portion of the peripheral edge of a trampoline showing the mat in part but part cut away, and showing a system for connection of the lower edge of the barrier net to the trampoline mat, FIG. 15 schematically illustrates an enclosure comprising two part enclosure support rods and barrier.
Figure 14A:
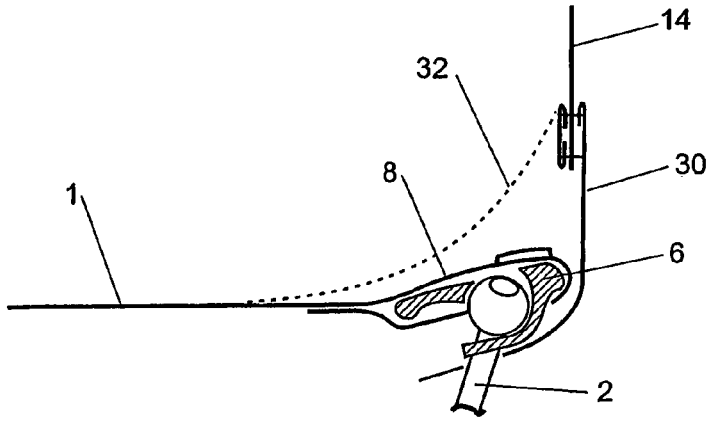

The lower peripheral edge of the barrier net is coupled directly or indirectly to the mat. Referring to FIGS. 14 and 14*a*, in the preferred form a strip of material 30 may be fixed such as by stitching for example to the lower edge of the barrier net 14, having holes 31 through which the upper ends of the spring rods 2 are passed during assembly of the trampoline, before connection of the upper end of each spring rod to the fitting 6 which couples the upper end of the spring rod to the peripheral edge of the mat, as shown, to thereby connect the lower peripheral edge of the barrier net 14 to the peripheral edge of the mat. This is shown in schematic cross-section in FIG. 14*a* which also shows a second flap 32 of material also fixed to the lower peripheral edge of the barrier net 14 which may optionally be provided to cover the peripheral edge of the trampoline.

Figure 15:
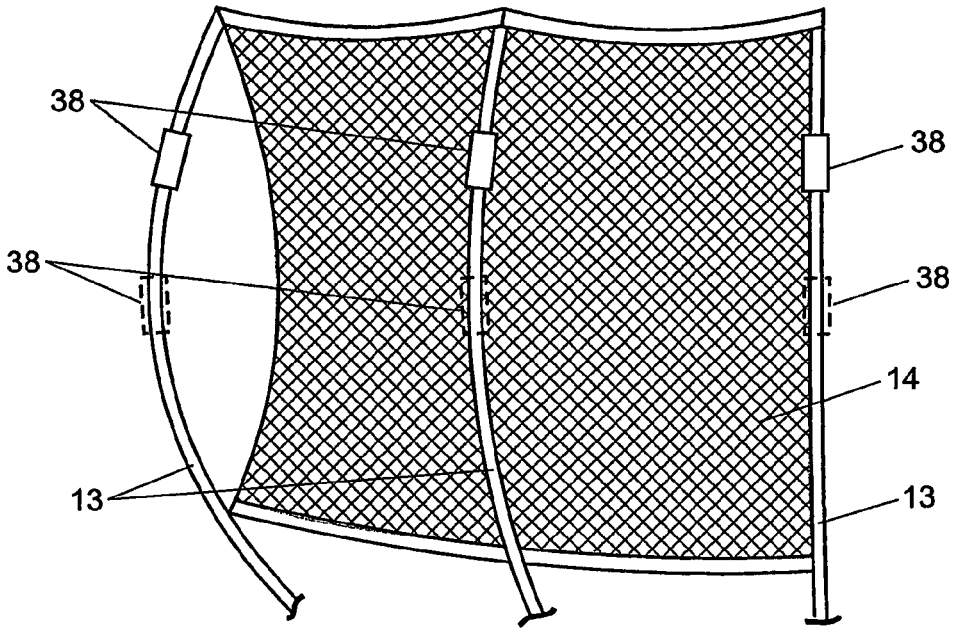

Referring to FIG. 15 the enclosure rods may be formed as one piece rods or alternatively in two parts connected by a tubular connector 35 into which the ends of the two parts fit to couple them together (like tent poles). Each enclosure rod 13 may be formed of two parts of approximately equal lengths so that when the two parts are connected to complete the enclosure rod the connector 38 will be positioned approximately midway along the length of the enclosure rod as shown for those connectors 38 indicated in phantom outline in FIG. 15. Alternatively the lengths of the two parts of each enclosure rod may be unequal, with the shorter part at the top so that the connector 38 will be positioned higher up the enclosure rod in the assembled trampoline, where a user is less likely to directly impact the more rigid segment of the enclosure rod formed by connector 38. Two part enclosure rods including connectors 38 are also shown in FIG. 5.

Figure 16:
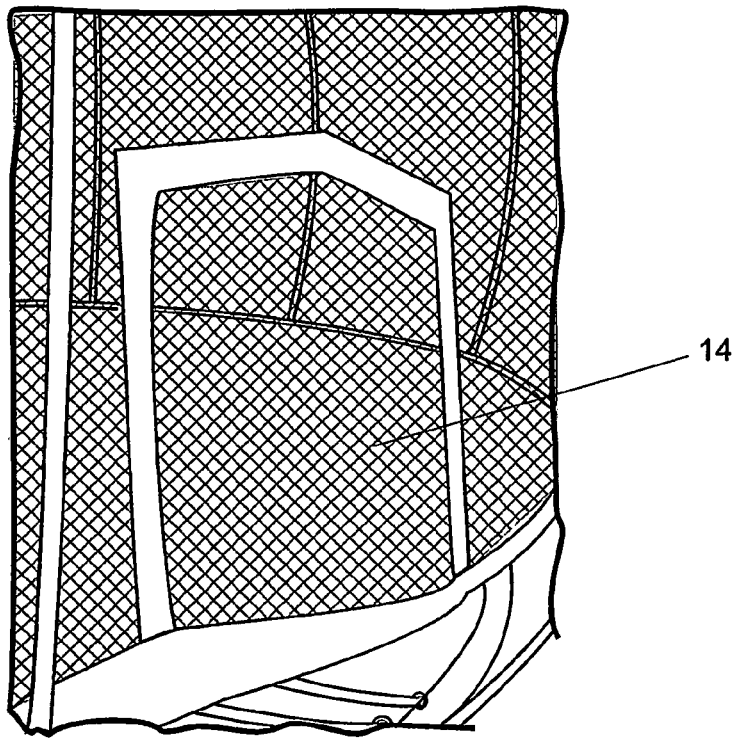
FIG. 16 shows a flap door through a barrier net of a trampoline of the invention.

Preferably as shown in FIG. 16, the barrier net incorporates an integral door 14 as a flap sewn into the net. A hook and loop fastening material such as VELCRO is used between the edges of the door and the aperture through the barrier net.

Alternatively, zippers may be used, or a combination of a hook and loop material and one or more zippers. The door aperture flap may be in any suitable form such as a square door flap and aperture as shown, or alternatively an inverted T-form with flaps on either side and a centre fastener or similar.

The foregoing describes the invention including preferred forms thereof. Alterations and modifications as will be obvious to those skilled in the art are intended to be incorporated and within the scope thereof as defined in the accompanying claims.

I claim:

1. A trampoline and enclosure system including:

a flexible mat;

a plurality of resiliently flexible spring rods each having a lower end retained by a frame of the trampoline and an upper end coupled to the mat about a periphery of the mat each rod extending from the frame upwards towards the mat at an incline so as to support the mat above the frame of the trampoline;

a barrier of a flexible material surrounding the mat above the mat and having a lower peripheral part coupled directly or indirectly to the mat; and a plurality of generally upright enclosure support members outside of the barrier relative to the mat which are resiliently flexible over at least the major part of the lengths thereof and which are retained at or towards the lower ends of the enclosure support members and which support the barrier above the mat, which are free to deform away from the mat when impacted by a user against an enclosure support member and/or against said barrier of flexible material, the barrier connecting together the enclosure support members at or towards an upper peripheral edge part of the barrier and at or towards the upper ends of the enclosure members so that at least said upper peripheral part of the barrier is in tension and so that such resilient deformation of one of the enclosure support members away from the mat causes resilient deformation of opposite enclosure support members towards the mat.

2. A trampoline and enclosure system according to claim 1, wherein said barrier comprises a flexible net material.

3. A trampoline and enclosure system according to claim 1 wherein the enclosure support members are resiliently flexible rods.

4. A trampoline and enclosure system according to of claim 3, wherein the enclosure support members are pultruded fibreglass rods.

5. A trampoline and enclosure system according to claim 1 wherein the barrier is supported by the enclosure support members by connections between the barrier at or towards an upper peripheral edge part of the barrier and the enclosure support members at or towards the upper ends of the enclosure support members which draw the upper ends of the enclosure support members away from their natural rest state, when connected only at their lower ends to the frame of the trampoline, and towards the centre of the mat.

6. A trampoline and enclosure system according to claim 1 including a flexible connecting element which connects the enclosure support members at or towards the upper ends of the enclosure support members to draw the upper ends of the enclosure support members away from their natural rest state, when connected only at their lower ends to the frame of the trampoline, and towards the centre of the mat.

7. A trampoline and enclosure system according to claim 6 wherein said flexible connecting element is fixed to or integral with the barrier at or towards an upper peripheral part of the barrier.

8. A trampoline and enclosure system according to claim 1, wherein the enclosure support members are retained by the frame of the trampoline at about the level on the frame of the trampoline at which the lower ends of the flexible spring rods are also retained by the frame of the trampoline.

9. A trampoline and enclosure system according to claim 1 wherein the lower ends of the enclosure support members are retained by the frame of the trampoline so that in their natural rest state, when connected only at the lower ends to the frame of the trampoline, the enclosure support members extend away from the mat.

10. A trampoline and enclosure system according to claim 3 wherein the barrier includes a series of pockets on an outside of the barrier which engage over upper ends of the enclosure support members.

11. A trampoline and enclosure system according to claim 10 wherein said pockets are at least half the length of the enclosure support members.

12. A trampoline and enclosure system according to claim 10 wherein the enclosure support members each comprise an enlarged upper end.

13. A trampoline and enclosure system according to claim 1 wherein the upper ends of the flexible spring rods pass through a lower peripheral section of the barrier below the mat to couple the barrier to the mat.

14. A trampoline and enclosure system including:

a flexible mat;

a plurality of resiliently flexible spring rods each extending between a base frame of the trampoline and a periphery of the mat each rod extending from the frame upwards towards the mat at an incline so as to support the mat above the frame of the trampoline;

a barrier of a flexible material surrounding the mat above the mat and having a lower peripheral part coupled directly or indirectly to the mat; and a plurality of enclosure support rods coupled to the trampoline only by a lower end of each enclosure support rod being retained by the base frame of the trampoline, and which extend above the mat to support the barrier above the mat, and which are each resiliently flexible over substantially the entire length thereof and which are the barrier connecting together the enclosure support members at or towards an upper peripheral edge part of the barrier and at or towards the upper ends of the enclosure members so that at least said upper peripheral part of the barrier is in tension and so that such resilient deformation of one of the enclosure support members away from the mat causes resilient deformation of opposite enclosure support members towards the mat.

15. A trampoline and enclosure system according to claim 14, wherein said barrier comprises a flexible net material.

16. A trampoline and enclosure system according to claim 14, wherein the enclosure support rods are pultruded fibreglass rods.

17. A trampoline and enclosure system according to claim 14 wherein the barrier is supported by the enclosure support rods by connections between the barrier at or towards an upper peripheral edge part of the barrier and the enclosure support rods at or towards the upper ends of the enclosure support rods which draw the upper ends of the enclosure support rods away from their natural rest state, when connected only at their lower ends to the frame of the trampoline, and towards the centre of the mat.

18. A trampoline and enclosure system according to claim 14 including a flexible connecting element which connects the enclosure support rods at or towards the upper ends of the enclosure support rods to draw the upper ends of the enclosure support rods away from their natural rest state, when connected only at their lower ends to the frame of the trampoline, and towards the centre of the mat.

19. A trampoline and enclosure system according to claim 14, wherein the enclosure support rods are retained by the frame of the trampoline at about the level on the frame of the trampoline at which the lower ends of the flexible spring rods are also retained by the frame of the trampoline.

20. A trampoline and enclosure system according to claim 14 wherein the lower ends of the enclosure support rods are retained by the frame of the trampoline so that in their natural rest state, when connected only at the lower ends to the frame of the trampoline, the enclosure support rods extend away from the mat.

21. A trampoline and enclosure system including:

a flexible mat;

a plurality of resiliently flexible spring rods each having a lower end retained by a frame of the trampoline and an upper end coupled to the mat about a periphery of the mat each rod extending from the frame upwards towards the mat at an incline so as to support the mat above the frame of the trampoline;

a barrier of a flexible material surrounding the mat above the mat and having a lower peripheral part coupled directly or indirectly to the mat; and a plurality of resiliently flexible generally upright enclosure support members outside of the barrier relative to the mat and which are retained at or towards the lower ends of the enclosure support members by the frame of the trampoline and which support the barrier above the mat, which enclosure support members are connected together at or towards the upper ends of the enclosure support members to draw the upper ends of the enclosure support members away from their natural rest state, when connected only at their lower ends to the frame of the trampoline, and towards the centre of the mat to tension the barrier.

22. A trampoline and enclosure system according to claim 21, wherein said barrier comprises a flexible net material.

23. A trampoline and enclosure system according to claim 21 wherein the enclosure support members are resiliently flexible rods.

24. A trampoline and enclosure system according to claim 21, wherein the enclosure support members are pultruded fibreglass rods.

25. A trampoline and enclosure system according to claim 21 wherein the barrier is supported by the enclosure support members by connections between the barrier only at or towards an upper peripheral edge part of the barrier and the enclosure support members.

26. A trampoline and enclosure system according to claim 21 including a flexible connecting element which connects the enclosure support members at or towards the upper ends of the enclosure support members.

27. A trampoline and enclosure system according to claim 26 wherein said flexible connecting element is fixed to or integral with the barrier at or towards an upper peripheral part of the barrier.

28. A trampoline and enclosure system according to claim 21, wherein the enclosure support members are retained by the frame of the trampoline at about the level on the frame of the trampoline at which the lower ends of the flexible spring rods are also retained by the frame of the trampoline.

29. A trampoline and enclosure system according to claim 21 wherein the lower ends of the enclosure support members are retained by the frame of the trampoline so that in their natural rest state, when connected only at the lower ends to the frame of the trampoline, the enclosure support members extend away from the mat.

30. A trampoline and enclosure system including:

a flexible mat;

a plurality of resiliently flexible spring rods each having a lower end retained by a frame of the trampoline and an upper end coupled to the mat about a periphery of the mat each rod extending from the frame upwards towards the mat at an incline so as to support the mat above the frame of the trampoline;

a plurality of resiliently flexible generally upright enclosure support members retained at or towards the lower ends of the enclosure support members by the frame of the trampoline and which are connected together at or towards the upper ends of the enclosure support members to draw the upper ends of the enclosure support members away from their natural rest state, when connected only at their lower ends to the frame of the trampoline, and towards the centre of the mat so that the area bounded by the upper ends of the enclosure support members is not greater than the area of the mat; and a barrier of a flexible material surrounding the mat above the mat and within the enclosure support members and supported above the mat in tension by the enclosure support members.

31. A trampoline and enclosure system according to claim 30, wherein said barrier comprises a flexible net material.

32. A trampoline and enclosure system according to claim 30 wherein the enclosure support members are resiliently flexible rods.

33. A trampoline and enclosure system according to claim 30, wherein the enclosure support members are pultruded fibreglass rods.

34. A trampoline and enclosure system according to claim 30 wherein the barrier is supported by the enclosure support members by connections between the barrier only at or towards an upper peripheral edge part of the barrier and the enclosure support members.

35. A trampoline and enclosure system according to claim 30 wherein the lower ends of the enclosure support members are retained by the frame of the trampoline so that in their natural rest state, when connected only at the lower ends to the frame of the trampoline, the enclosure support members extend away from the mat.

* * * * *